US010571208B2

(12) United States Patent
Schneider et al.

(10) Patent No.: US 10,571,208 B2
(45) Date of Patent: Feb. 25, 2020

(54) AMMUNITION FEED FOR FEEDING A BELTED AMMUNITION

(71) Applicant: RHEINMETALL WAFFE MUNITION GMBH, Unterluess (DE)

(72) Inventors: Hubert Schneider, Dietingen (DE); Andy Mueller, Villingendorf (DE); Markus Schweizer, Dornhan-Weiden (DE)

(73) Assignee: Rheinmetall Waffe Munition GmbH, Unterluess (DE)

( * ) Notice: Subject to any disclaimer, the term of this patent is extended or adjusted under 35 U.S.C. 154(b) by 22 days.

(21) Appl. No.: 16/008,596

(22) Filed: Jun. 14, 2018

(65) Prior Publication Data

US 2018/0299216 A1 Oct. 18, 2018

Related U.S. Application Data

(63) Continuation of application No. PCT/EP2016/080996, filed on Dec. 14, 2016.

(30) Foreign Application Priority Data

Dec. 14, 2015 (DE) ..... 10 2015 121 772

(51) Int. Cl.
*F41A 9/33* (2006.01)
*F41A 9/37* (2006.01)

(52) U.S. Cl.
CPC . *F41A 9/33* (2013.01); *F41A 9/37* (2013.01)

(58) Field of Classification Search
CPC ..... F41A 9/33; F41A 9/37
USPC ..... 89/33.2
See application file for complete search history.

(56) References Cited

U.S. PATENT DOCUMENTS

| | | | | |
|---|---|---|---|---|
| 2,093,705 A | | 9/1937 | Browning | |
| 2,404,325 A | | 7/1946 | Swebilius | |
| 2,582,288 A | * | 1/1952 | Simpson | F41A 3/34 89/167 |
| 3,680,432 A | * | 8/1972 | Rocha | F41A 9/37 89/33.04 |
| 4,333,386 A | * | 6/1982 | Montgomery | F41A 9/37 89/33.04 |

(Continued)

FOREIGN PATENT DOCUMENTS

| | | |
|---|---|---|
| CH | 136955 A | 12/1929 |
| DE | 125933 C | 8/1900 |

(Continued)

OTHER PUBLICATIONS

International Search Report dated Feb. 16, 2017 in corresponding application PCT/EP2016/080996.

*Primary Examiner* — Reginald S Tillman, Jr.
(74) *Attorney, Agent, or Firm* — Muncy, Giessler, Olds & Lowe, P.C.

(57) ABSTRACT

An ammunition feed device of a belted ammunition in a weapon system for delivery before a closure or before a closure head, wherein the ammunition must be drawn from the ammunition belt by a cartridge hook and delivered to the closure. To prevent a misfire, etc., the cartridge hook is integrated in the weapon system separately from the closure. The cartridge hook is carried or placed by the closure, when the closure has covered a distance to the rear or must still cover a distance forward.

20 Claims, 10 Drawing Sheets

(56) References Cited

U.S. PATENT DOCUMENTS

| | | | | | |
|---|---|---|---|---|---|
| 4,539,890 | A * | 9/1985 | Bosshard | F41A 9/40 | 89/33.04 |
| 5,159,147 | A | 10/1992 | Menges et al. | | |
| 5,227,578 | A * | 7/1993 | Reynolds | F41A 3/34 | 89/186 |
| 7,568,421 | B2 * | 8/2009 | Cummings | F41A 9/31 | 42/87 |

FOREIGN PATENT DOCUMENTS

| | | | |
|---|---|---|---|
| DE | 3627360 | C1 | 4/1992 |
| DE | 102007062548 | A1 | 4/2009 |
| DE | 202014102779 | U1 | 9/2015 |
| EP | 2018509 | A2 | 1/2009 |
| EP | 2198231 | A1 | 6/2010 |
| EP | 2257763 | A1 | 12/2010 |
| WO | WO2007131653 | A2 | 11/2007 |
| WO | WO2009049723 | A1 | 4/2009 |
| WO | WO2009118093 | A1 | 10/2009 |

* cited by examiner

AMMUNITION FEED FOR FEEDING A BELTED AMMUNITION

This nonprovisional application is a continuation of International Application No. PCT/EP2016/080996, which was filed on Dec. 14, 2016, and which claims priority to German Patent Application No. 10 2015 121 772.4, which was filed in Germany on Dec. 14, 2015, and which are both herein incorporated by reference.

BACKGROUND OF THE INVENTION

Field of the Invention

The present invention relates to an ammunition feed for feeding at least one belted ammunition to a weapon before a breech or breech head of the weapon. The weapon is an externally powered or self-powered weapon system, for example an automatic weapon or a machine gun, with a straight-fed breech or ammunition. In a preferred embodiment, two belted ammunitions of the weapon are fed. The two ammunition feeds transfer the ammunition from one direction and thereby overlap. To avoid misfiring, the extraction of the ammunition from the ammunition belt is separated from the movement of the breech. This makes it possible that the ammunition can only be extracted from the ammunition belt after a predetermined distance has been traveled by the breech.

Description of the Background Art

Weapon systems are known from EP 2 018 509 B1, EP 2 198 231 B1 and EP 2 257 763 B1, which are all incorporated by reference herein.

An ammunition feed from different ammunition containers on a common rotor of a weapon from one direction is described by DE 10 2007 062 548 A1, which is incorporated by reference herein.

DE 36 27 360 C1, which corresponds to U.S. Pat. No. 5,159,147, which is incorporated herein by reference, discloses a dual-cartridge alternating feed for an externally powered automatic weapon with two feed chutes parallel to one another. For feeding the ammunition from the two feed chutes, the direction of rotation of the rotor changes, so that the respective cartridge is transported directly from a waiting position of a feeding star wheel that is fixed to the weapon housing into a recess of the rotor and is transferred to a breech by incremental movements of the rotor for passing it on into a loading chamber.

DE 20 2014 102 779.3, describes an ammunition feed for feeding ammunition into a weapon for delivering the ammunition before a breech from preferably two directions, right and left. For this purpose, a common feed is displaced in the vertical plane, so that a right-hand or left-hand transporting star is incorporated in the ammunition feed or the ammunition propulsion. By displacing the common feed, the ammunition is fed from the right or from the left and placed before the breech or breech head.

The feeding of belted ammunition and delivery of the same before a breech or breech head is also known. Here, the ammunition must be extracted from the belt and delivered to the breech or breech head. The extraction of the ammunition from the belt link takes place during the return of the breech by a cartridge hook, the delivery before the breech takes place during its advancement (see the Browning machine gun). It is disadvantageous that the next ammunition to be fired is already extracted from the belt as the breech moves back. This ammunition is then already in the weapon system if firing is interrupted. In this situation, the weapon system is not safe. In particular, incorporation of a further ammunition feed from the same direction entails the problem of misfiring.

SUMMARY OF THE INVENTION

It is therefore an object of the present invention to provide a novel ammunition feed.

In an exemplary embodiment, the invention is based on the concept of mechanically separating the extraction of the ammunition and the movement of the breech from one another. The ammunition is for its part only fetched or extracted from the ammunition belt when the breech has already traveled a distance. The extraction of the ammunition consequently only takes place at a point in time at which the breech is already unlocked and partly returned. If at this point in time the firing has been completed and the weapon system stopped, there is no ammunition in the weapon system, since it has not yet been extracted from the ammunition belt.

The separation of the extraction of the ammunition from the movement of the breech is implemented by an ammunition extractor or a cartridge hook being incorporated separately from the breech return, and preferably fixed to the cradle. This allows the two movements, the extraction and the return or advancement of the breech, to be separated from one another. The breech travels a distance and only after this distance carries the cartridge hook along with it, i.e. at a later point in time. During the advancement, the breech carries the cartridge hook along with it over this distance and places the cartridge hook at this position in a deactivating manner, the cartridge hook already hooking into the next ammunition waiting in the extractor groove (cartridge case).

As the fitting location, the invention provides a feed that is integrated in the weapon system in the known way, fixed to the cradle but movable. This feed comprises at least one side guiding part, which receives the necessary guides or control cams for the cartridge hook. An inner guide cam and an outer control cam for the cartridge hook are provided. The inner guide serves the purpose of being able to move the cartridge hook with the breech backward and forward. The cartridge hook can be placed in a deactivating manner by the breech in a downwardly facing front portion of the cam. The outer control cam serves the purpose that the cartridge hook can extract the ammunition from an ammunition belt and deliver it to the breech. The two cams, the guide cam and the control cam, can also be incorporated on one side in the side guiding part, with the same function.

In order that the cartridge hook only acts on the ammunition in the ammunition belt when the breech has traveled a distance, the breech has a guide or cam. This guide is located in the upper region of the breech or the breech head (chamber). This guide functionally interacts with the inner guide cam and the outer control cam of the cartridge hook by way of a protrusion, for example, a pin of the cartridge hook engages in this guide. The same pin also lies in the inner guide cam of the side guiding part of the feed. Together with the inner guide cam of the side guiding part of the feed, this guide cam in the breech makes it possible that the cartridge hook can be carried along with the movement of the breech and placed in a predefined position in a deactivating manner during the advancement, i.e. can be separated from the further movement of the breech.

The feed or the side guiding part may additionally be moved laterally, for example by pivoting. This particular embodiment allows the cartridge hook to be moved out of the guide of the breech. By this measure, the safety of the weapon system can be increased, since the cartridge hook, fixed to the cradle, cannot itself perform any movements. This position of the cartridge hook, disengaged from the breech, can be used for transporting the weapon system.

Two ammunition feeds can be provided on the weapon system. These ammunition feeds can be deployed, for example, from the right and from the left.

In an embodiment, it is provided to incorporate the ammunition feed from one and the same direction, right or left. For this purpose, the side guiding part with the guide and control cam is mirrored and incorporated on one and the same feed. The feed is also movably incorporated in the cradle and can be displaced, etc. In this embodiment, the feed is however preferably also pivoted. The described mimic of the inner guide cam and outer control cam for guiding and controlling the cartridge hook is mirrored as an opposite side guiding part of the feed, incorporated in it. The cartridge hook itself is also mirrored and integrated in the feed. Both cartridge hooks, right and left, are coupled with the breech according to the choosing of ammunition or selection of ammunition, in order then to interact functionally with it.

In an embodiment, it is provided that the two ammunition feeds are arranged in such a way that the upper one runs over the lower one, which for its part is diverted to the same feeding level of the first ammunition. The lower ammunition feed then interacts with the left-hand cartridge hook and the upper ammunition feed interacts with the right-hand cartridge hook, or vice versa. For this purpose, the respective side guiding part with the mimic for guiding and controlling the right-hand or left-hand cartridge hook is moved or deployed into the weapon system. As already explained, the moving preferably takes place by pivoting the entire feed. The pivoting of the feed results from the choosing of the ammunition by an operator. With the moving of the feed, the upper or lower ammunition feed or the upper or lower belted ammunition is deployed or retracted. With the displacing or pivoting, the respective cartridge hook is also displaced or pivoted together with the ammunition feed/ammunition belt into or out of the weapon system. As a result, either the belted ammunition from the lower ammunition feed or the belted ammunition from the upper ammunition feed can be fired. During the displacing or pivoting, the cartridge hook always remains aligned with the ammunition that is next to be fired from the ammunition belt. One of the advantages of this structural connection between the cartridge hook and the ammunition feed is that a realignment of the cartridge hook with the cartridge rim of the ammunition next to be fired is not necessary. Moreover, the weapon system is already ready to fire when the respective ammunition feed is deployed.

For firing the ammunition from the upper ammunition belt, this ammunition belt is moved down. The end position (beginning of the ammunition belt) of the upper ammunition belt or the feeding ammunition/cartridge then assumes the same height as previously the lower ammunition belt. The two cartridge hooks on the right and left are for their part located at the same height in relation to one another. Both cartridge hooks travel the same distance for feeding the ammunition into a groove on the end face of the breech or the breech head.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Right, left, forward and backward are seen in the direction of firing and are defined as such.

Figure 1:
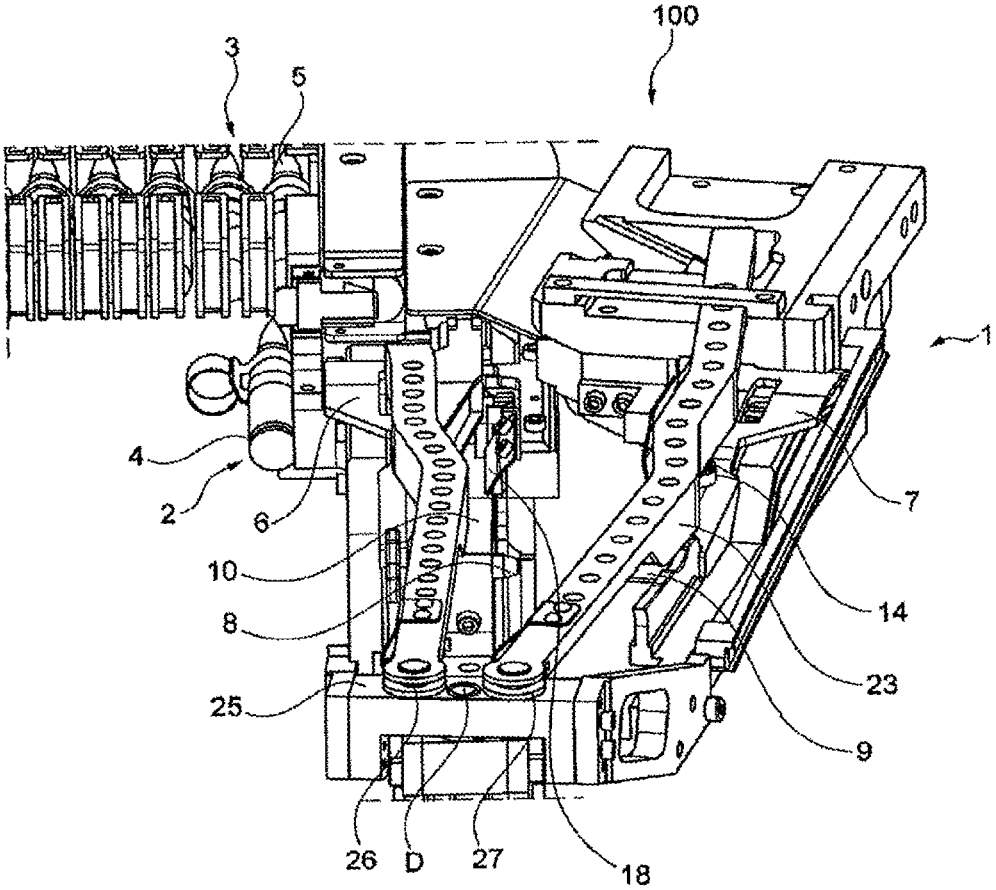
FIGS. 1-3 show a feed for a weapon system with two ammunition feeds.
Figure 2:
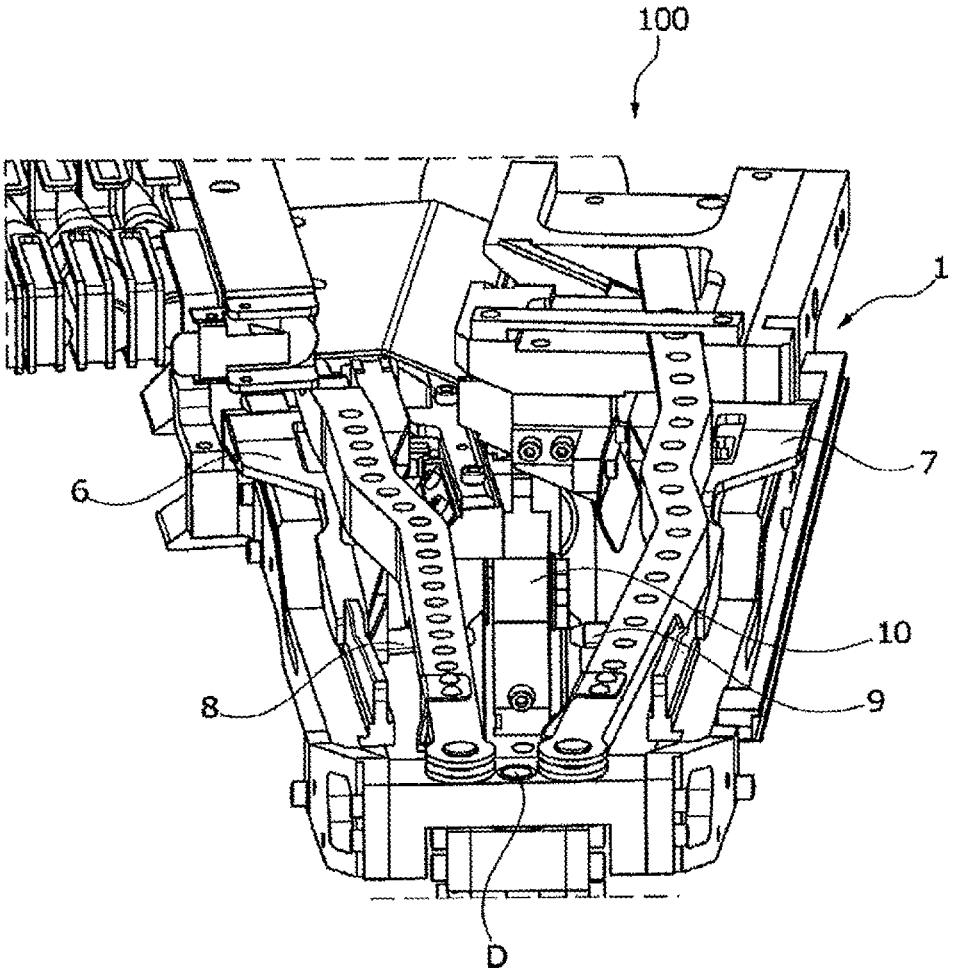
Figure 3:
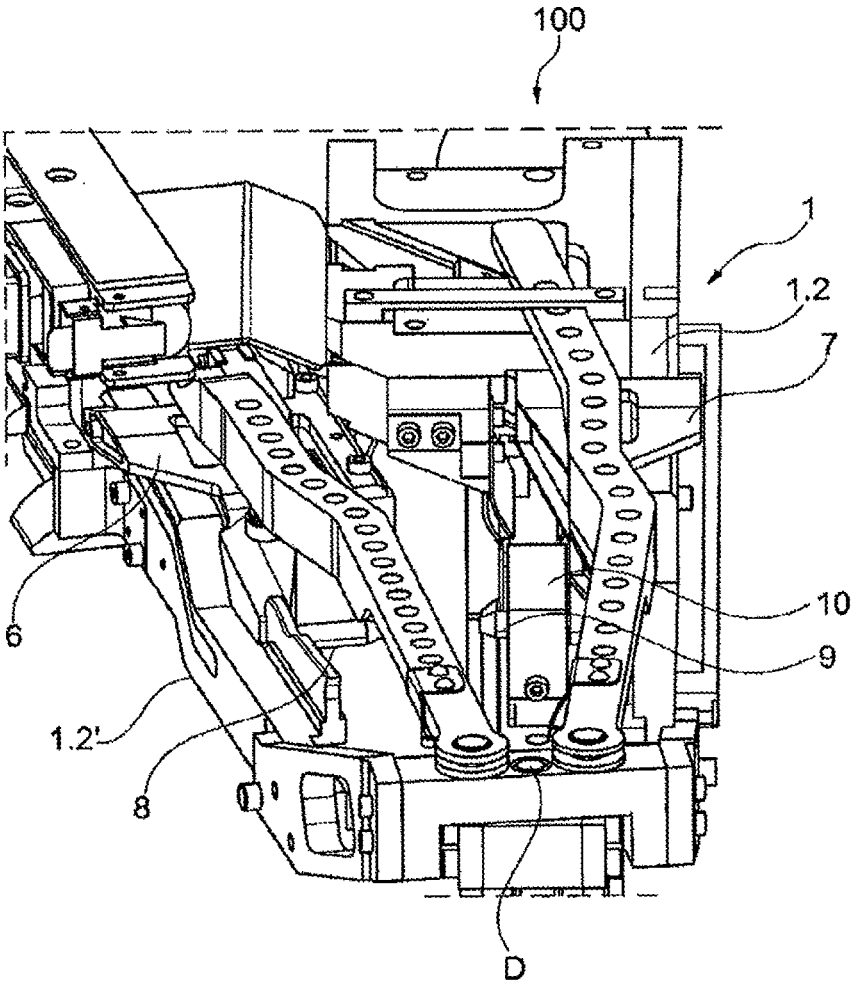

FIGS. 1-3 show in a plan view a dual ammunition feeding device 100 that has a feed 1 for a weapon system. A first ammunition feed 2 (for example ammunition container) and a second ammunition feed 3 (for example ammunition chute) are linked with the feed 1. The first ammunition feed 2 comprises a first belted ammunition 4 and the second ammunition feed 3 comprises a second belted ammunition 5. The two ammunitions 4 and 5 are preferably two different types of ammunition, but may also be of the same type.

Also incorporated on the feed 1 are a left-hand cartridge hook 6 and a right-hand cartridge hook 7. Both have in each case a pin 8 and 9, respectively, which face one another. The feed 1 can be pivoted about a pivot point D. A breech or a breech head of the weapon system is identified by 10. In FIG. 1, this breech or breech head is functionally coupled with the left-hand cartridge hook 6 by the pin 8 of the left-hand cartridge hook 6. In this position of the feed 1, the first ammunition 4 is fed to the weapon system. In FIG. 2, neither of the two cartridge hooks 6, 7 is coupled with the breech 10 by way of its pin 8, 9. This position can be used as a transporting position of the weapon system. It forms a safe position, since neither the ammunition 4 nor the ammunition 5 can be fed to the weapon system. In FIG. 3, the right-hand cartridge hook 7 is functionally connected to the breech 10 by way of its pin 9, so that then the ammunition 5 can be introduced into the weapon system and can be brought before the breech 10.

Figure 4:
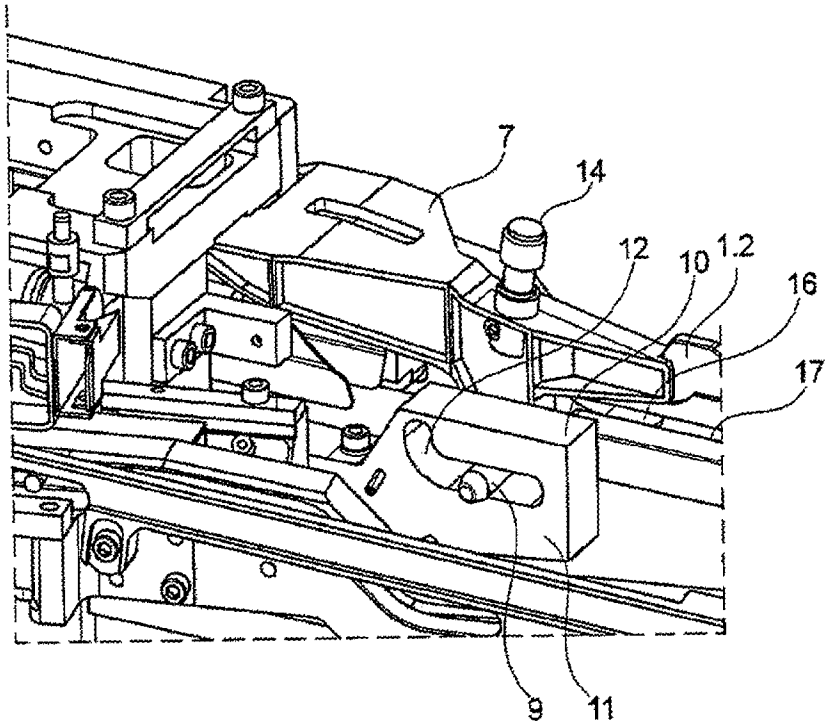
FIG. 4 shows a view of the right-hand side of the feed from FIGS. 1-3.

FIG. 4 represents a detailed representation of the right-hand cartridge hook 7, the pin 9 of which engages in the breech 10 a guide or guide cam 11 (breech cam 11) thereof. The breech cam 11 of the breech 10 has an upwardly directed clearance 12 in the front region of the breech 10. This clearance 12 forms the carrying-along position of the cartridge hook 7. The breech 10 itself is located in its forward position and is locked.

Figure 5:
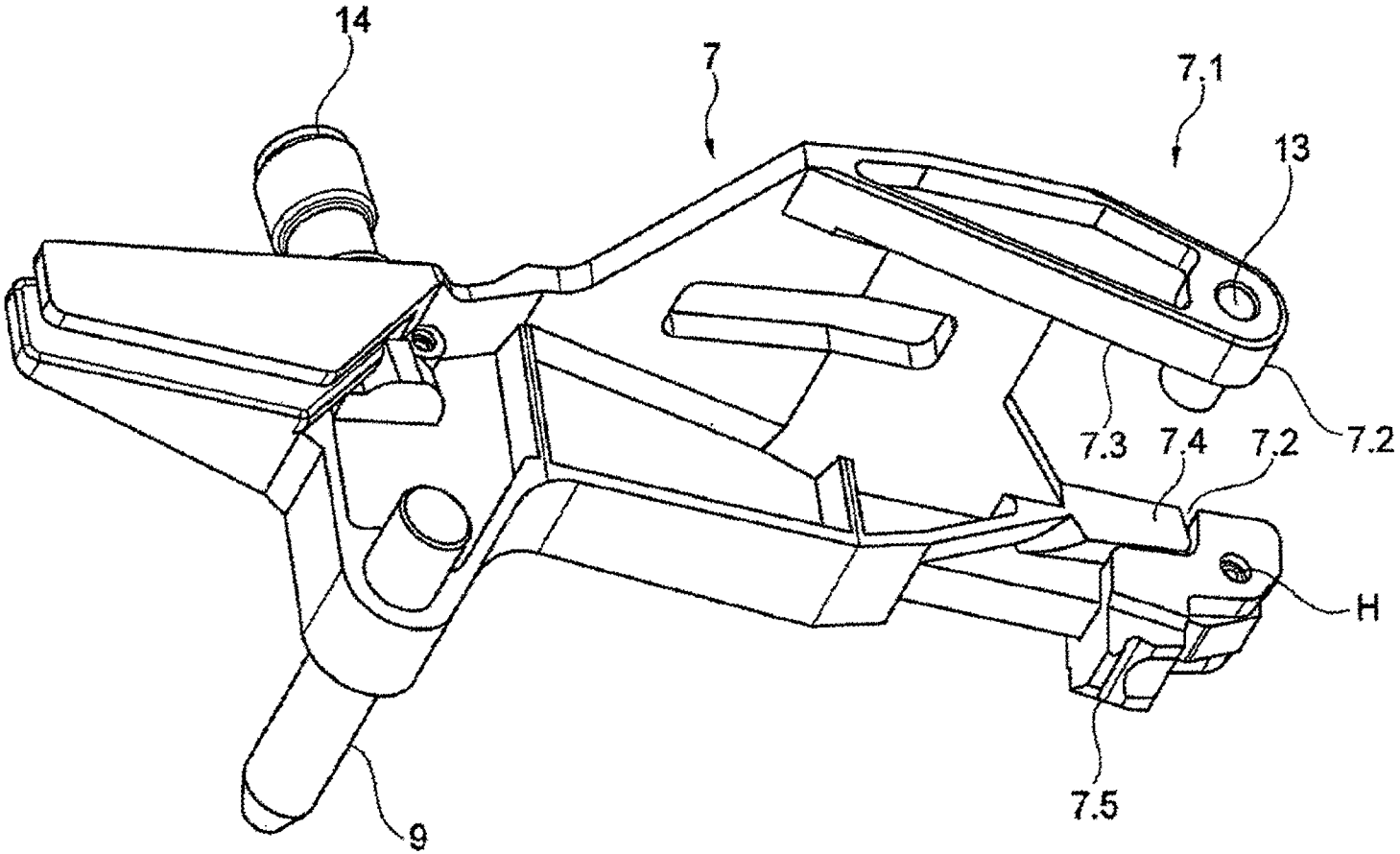
FIG. 5 shows a view from below of a cartridge hook.
Figure 6:
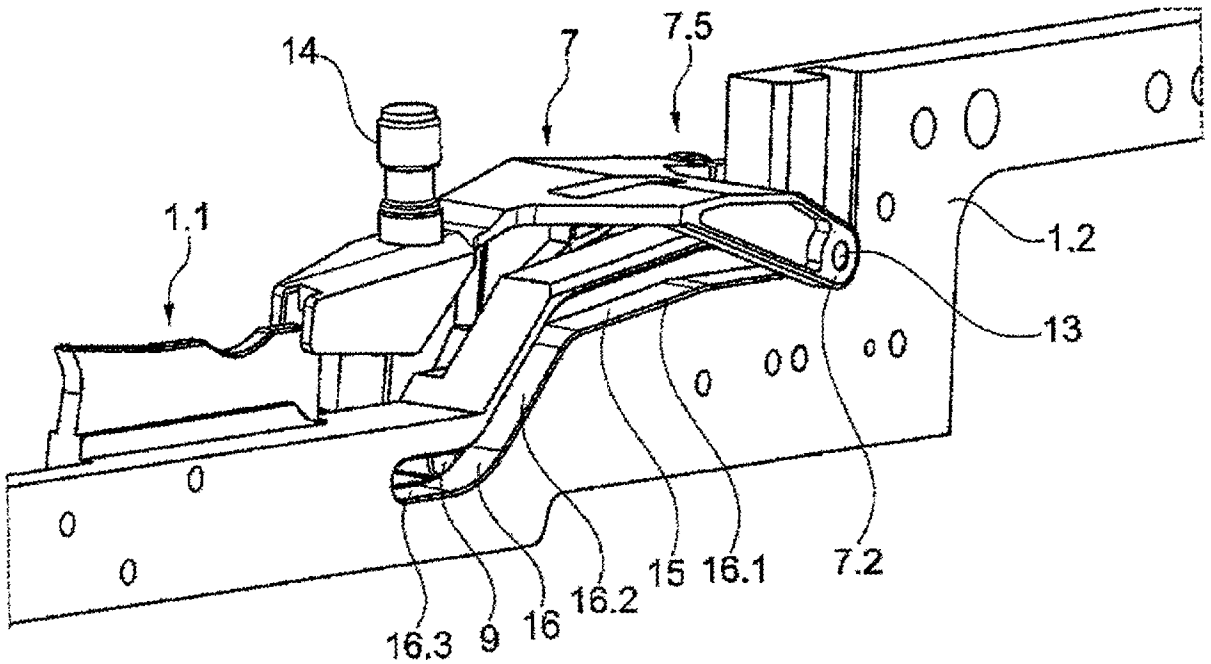
FIG. 6 shows a representation of the cartridge hook and of a right-hand side guiding part of the feed, from outside.

The cartridge hook 7 is represented more specifically in FIG. 5. The cartridge hook 7 has in its front portion 7.1 a fork or U shape 7.2, which enclose the side 1.2 of the feed 1. Incorporated on the right-hand inner side 7.3 of the U shape 7.2 is a bolt 13. On the end face 7.4 of the left-hand part of the fork 7.2 is the actual hook 7.5. The cartridge hook 7 is stabilized by way of a supporting part 1.1 of the feed (FIG. 6) when the latter is guided together with the breech 10 backward and over the supporting part 1.1. A further bolt 14 is attached above the cartridge hook 7 on the latter. On the outside, the feed 1 has on the right-hand side guiding part 1.2 a guide 15 incorporated in it. This serves as a control cam 16 for the cartridge hook 7. In this control cam 16 engages the bolt 13 of the fork 7.2. The control cam 16 has a slightly sloping portion 16.1 adjoining a short straight portion, a slope 16.2 and also a further straight portion 16.3.

Figure 7:
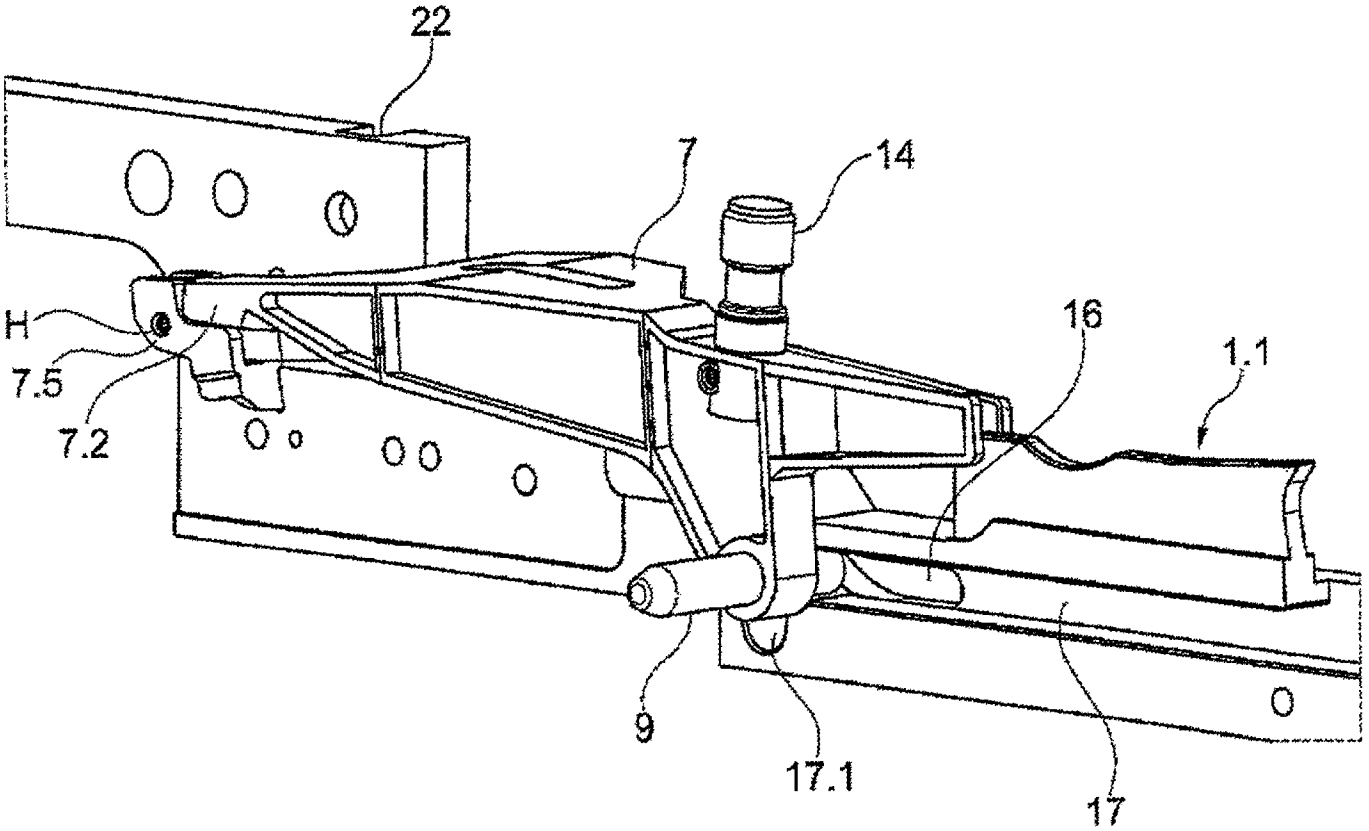
FIG. 7 shows a representation of the cartridge hook and of the outer side guiding part of the feed, from inside.

FIG. 7 shows the guide cam 17 lying inside in the side part 1.2 of the feed. This guide cam has at its front end a downwardly facing clearance 17.1. As already explained, the separation of the control cam 16 and the guide cam 17 between the outer side and the inner side of the side guiding part 1.2 is not necessary. There is also the possibility of incorporating the two, with the same function, either on the outer side or on the inner side of the side guiding part 1.2. Correspondingly, the cartridge hook 7 can then dispense with a fork shape 7.2 in the front region 7.1.

Figure 8:
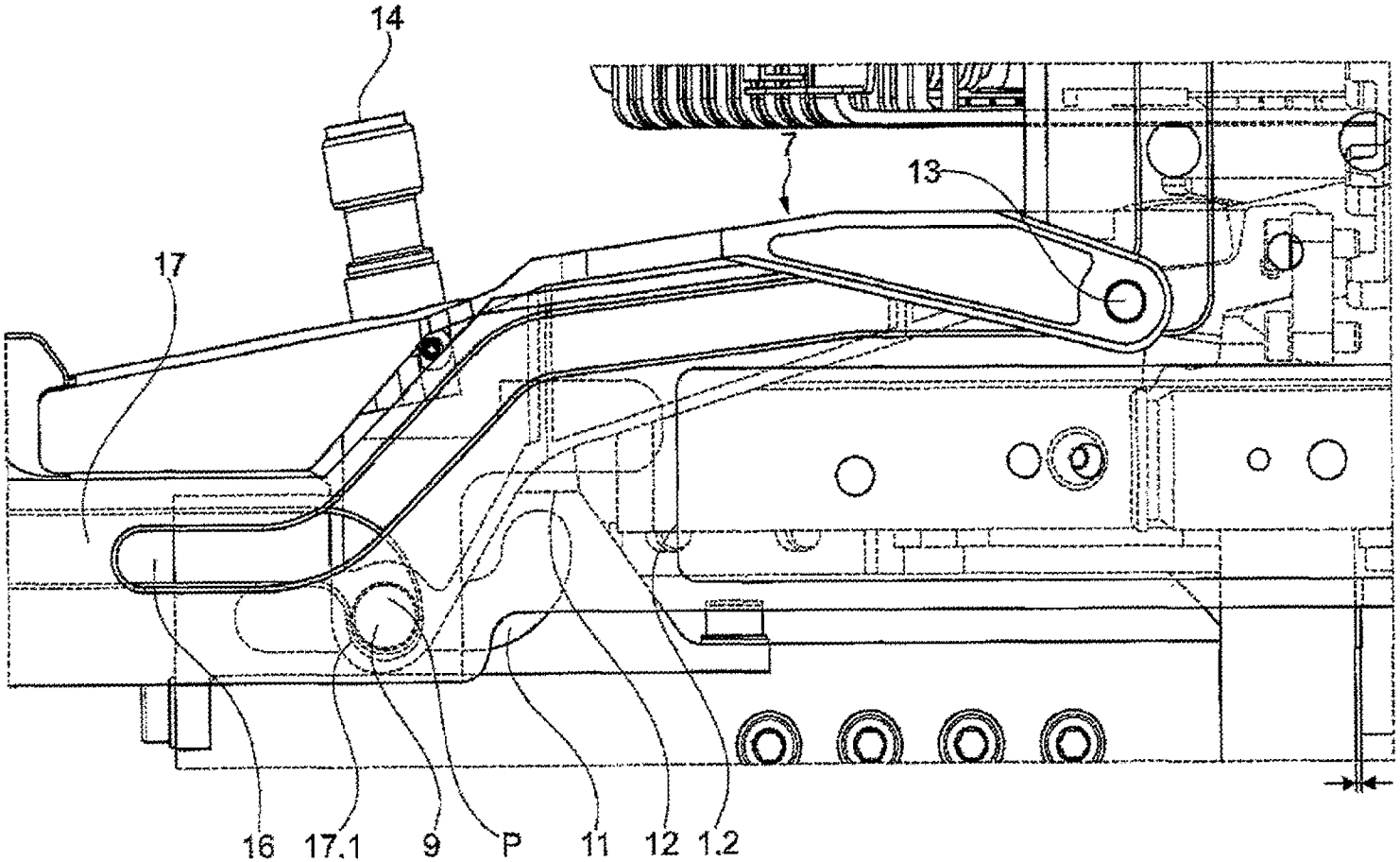
FIG. 8 shows a slightly transparent representation of the right-hand side guiding part of the feed with various guide cams and control cams for the cartridge hook in interaction with a breech cam incorporated in the breech head.

FIG. 8 shows in a slightly transparent representation a side view of the outer right-hand part 1.2 of the feed 1 (side guide of the cartridge hook 7). An inner guide 17 (FIG. 7) in this side guide 1.2 of the feed 1 serves the purpose that the pin 9 of the cartridge hook 1 can be moved together with the breech 10 or the breech head. In this representation according to FIG. 6, the cartridge hook 7 is placed in a defined position in a deactivating manner. The cartridge hook 7 is located with its hook 7.5 behind the cartridge rim 5.1 of the ammunition 5 located in the ammunition belt.

Figure 9:
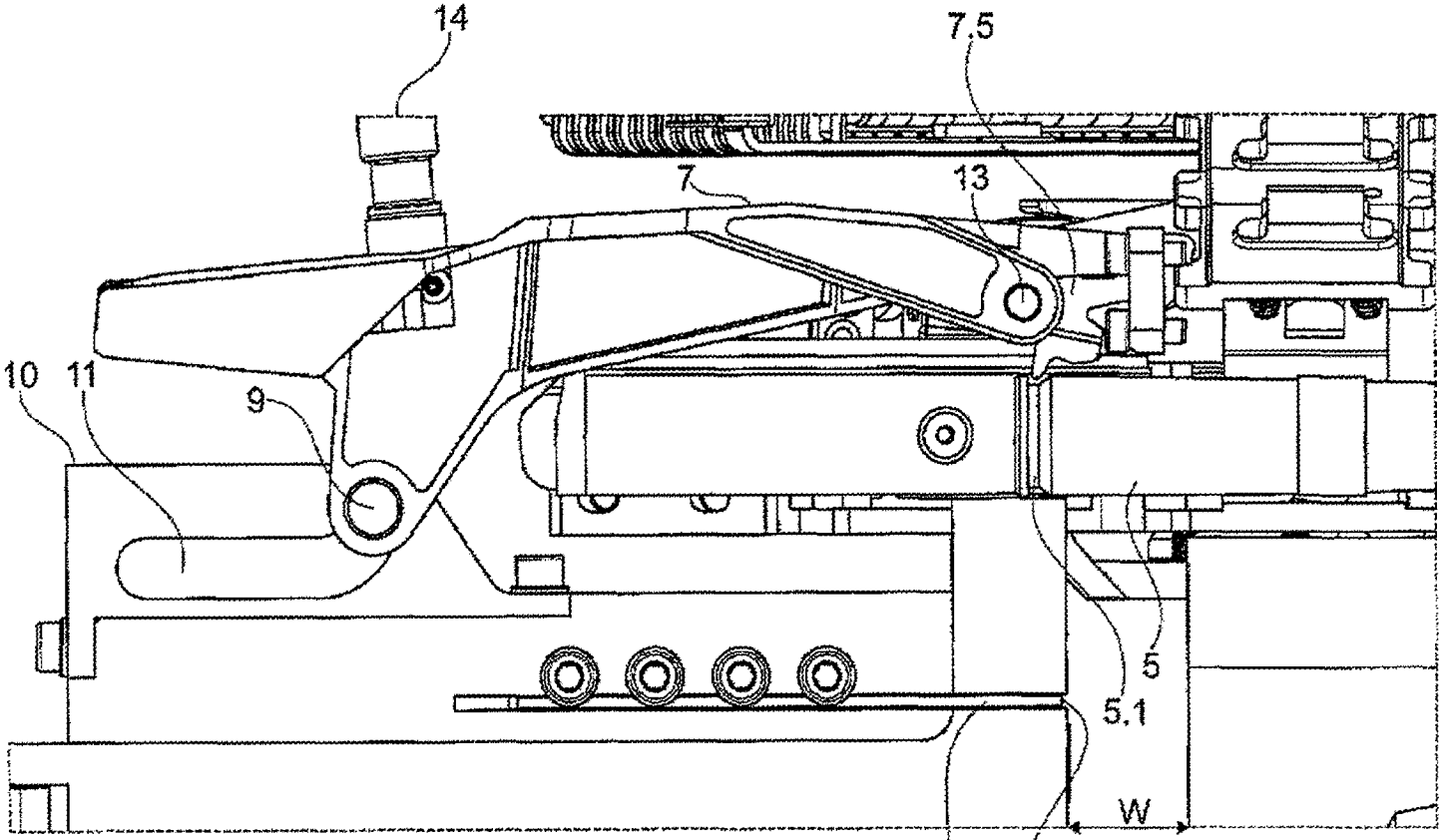
FIG. 9 shows a representation of the engagement of the cartridge hook with a cartridge base of an ammunition.

FIG. 9 shows the engagement of the cartridge hook 7 with the ammunition 5 for extracting the same from the ammunition belt of the ammunition feed 3.

Figure 10:
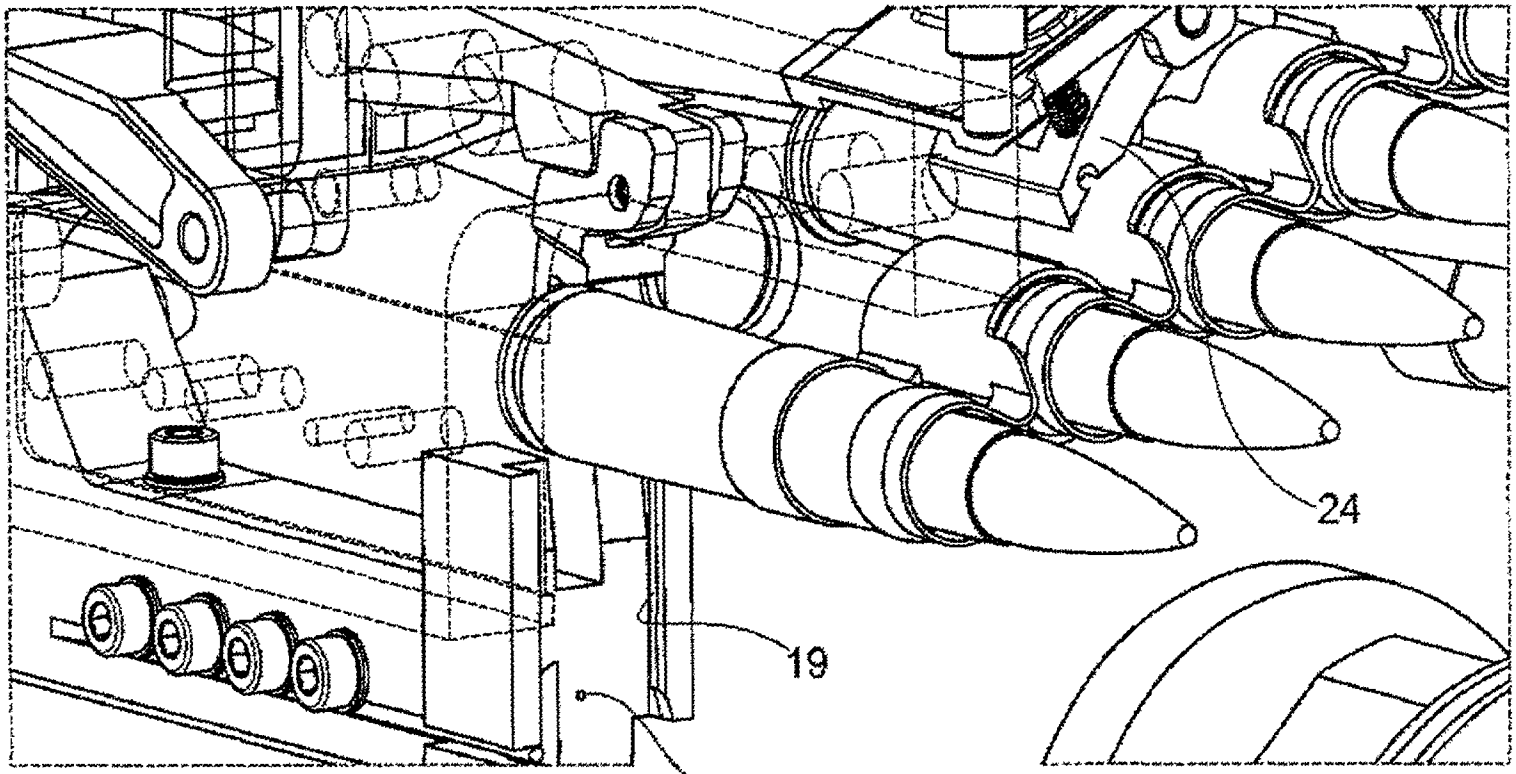
FIG. 10 shows a slightly transparent representation of the interaction of the cartridge hook, the ammunition and a breech of the weapon.

In FIG. 10, the breech 10 or the breech head is represented more specifically in a slightly transparent representation. Incorporated in the end face 10.1 of the breech 10 is the groove 18. The exit of a firing pin for striking a primer of the ammunition 4, 5 is identified by 20.

The way in which the extraction of the ammunition 5 (4) from the ammunition feed 3 (2) functions and the delivery of a new ammunition 5 (4) before the breech 10 is described on the basis of the right-hand cartridge hook 7 and the belted ammunition 5 of the upper ammunition belt 3:

For firing the ammunition 5 from the upper ammunition belt 4, the ammunition belt is moved downward (see spring-loaded plate 24, FIG. 10).

Beginning with the locking of the breech 10 and the igniting of the ammunition 5, the cartridge hook 7 lies in its deactivated position P (FIG. 8). The breech 10 lies against the firing chamber of the weapon system. After ignition has taken place, the breech 10 is guided backward into its back position for the delivery of a new ammunition 5. The cartridge hook 7 remains in its current position, while the breech 10 is guided backward. After a predetermined distance W (is determined by the length between the deactivated position P of the cartridge hook 7 and the clearance 12 of the breech cam 11), when the pin 9 of the cartridge hook 7 has covered this distance in the breech cam 11 and run into the clearance 12, the breech 10 carries the cartridge hook 7 along with it in the backward direction. At this point in time, the cartridge hook 7 is in line with a front end face 10.1 of the breech 10 or breech head. The cartridge hook 7 runs with its pin 9, projecting on both sides, out of its clearance 17.1 into the inner guide 17 and is guided backward along the latter together with the breech 10. With the backward guiding of the cartridge hook 7, the bolt 13 runs along its outer control cam 16 on the right-hand side guiding part 1.2.

In the straight portion 16.1, the cartridge hook 7, which has already been hooked into a cartridge rim 5.1 of the ammunition 5 during the advancement of the breech 10, is carried along. With the carrying along of the cartridge hook 7, the ammunition 5 is extracted from the ammunition belt 3 and likewise carried along. The slope 16.2 forms a diverting guide and serves the purpose of pressing the ammunition 5 extracted from the ammunition belt 3 into a groove 19 on the front end face 10.1 of the breech 10. That is to say that the cartridge or ammunition is diverted when the cartridge hook 7 and the breech 10 are together guided backward after a time delay. The diverting of the extracted ammunition 5 is determined by the slope 16.2. On the way back, the cartridge hook 7 is correspondingly controlled in the downward direction by way of the slope 16.2, whereby the cartridge hook 7 or its hook 7.5 presses the ammunition 5 extracted from the ammunition belt 3 into the end-face groove 19 of the breech 10 (latching onto and engaging). To avoid the ammunition 5 being able to slip out of the hook 7.5 when it is being transported, a stop 18 is incorporated. These press slightly against it from below. When the ammunition 5 is being pressed down, the stop 18 yields, in order to allow engagement of the cartridge rim 5.1 in the groove 19 of the breech 10. Together with an ejector 21 incorporated laterally in the breech 10, the pressing down of the ammunition 5 brings about ejection of the empty cartridge case guided with the breech 10 from a weapon barrel of the weapon system. The second straight portion 16.3 serves for restricting this diversion. If the bolt 13 runs into the further straight portion 16.3 of the control cam 13, further diversion or pressing down is prevented (restricted).

On its way forward, the breech 10 then has before it a new ammunition 5, which it pushes into the weapon barrel (firing chamber) of the weapon system. During the advancement of the breech 10, the cartridge hook 7 is also carried along with it. The cartridge hook 7 runs along its guide 17 up to the clearance 17.1 and into the latter. The pin 9 is in this case drawn out of the clearance 12, i.e. out of the carrying-along position of the cartridge hook 7, of the breech 10. The breech 10 for its part continues to run, while the pin 9 of the cartridge hook 7 slides along the breech cam 11. In its forward position, this breech 10 is locked again. In this position P, the cartridge hook 7 is deactivated.

During the moving forward of the breech 10, the bolt 13 is guided along the control cam 16. When moving along the slope 16.2, it raises the cartridge hook 7 and places it against the cartridge rim 5.1 of the ammunition 5 to be newly fetched.

The weapon is loaded, firing can begin again.

For easy mounting of the cartridge hook 7 in the control cam 13, a vertical straight portion 22 is incorporated in the side guiding part 1.2.

The type of mounting of the pin 9 of the cartridge hook 7 within the cams 11 and 17 in its deactivated position has the advantage that the cartridge hook 7 can respond without any problem to the way in which the weapon system recoils.

For further transport of the belted ammunition 5, the bolt 14 is attached to the cartridge hook 7. This bolt tilts away laterally when the ammunition 5 is diverted by the cartridge hook 7. The bolt 14 performs a rocking movement. A rocker 23 that is linked to the bolt 14 causes the belted ammunition 5 to be extracted from the ammunition feed 3. This takes place by way of a carrier, which acts on the ammunition belt of the ammunition 5 and moves it, i.e. for example pushes and/or pulls it.

A further particular structural feature is also that the pivot point H of the hook 7.5 is located at the front of the cartridge hook 7. When the breech 1 is moved back and the pin 9 slides out of its inactive position into the clearance 12 of the breech cam 11, a lever movement acts on the cartridge hook 7. This entering of the pin 9 into the clearance does not however exert any lever movement on the hook 7.5, since the latter is arranged at a pivot point H on the cartridge hook 7. This achieves the effect that a lever movement can act on the hook 7.5, and consequently on the ammunition 5.

The ejector 21, which forms the stop for the ammunition 5, can be used for secure abutment of the ammunition 5 brought before the breech 10. For this purpose, the ejector 21 is guided in a groove 28 in the breech 10, which lies below the center axis of the breech. It must in this case be ensured that the primer of the ammunition 5 is aligned in line in a plane with the firing pin (20).

The functional sequence of the feeding of the ammunition for the weapon system is described on the basis of the right-hand cartridge hook 7. Since the left-hand cartridge hook 6 and the entire mimic comprising the right-hand side guide 1.2 of the feed 1 is mirrored for the left-hand side guide 1.2', the functional sequence for the feeding of the ammunition of the first ammunition 4 from the lower ammunition feed 2 is correspondingly as described for the upper ammunition feed, just mirror-inverted.

The construction of the feed described above can also be used for only one ammunition feed 2 in the weapon system. In this embodiment, only one side guide is then necessary, primarily the left-hand side guiding part. Then the pin 8 engages in the breech cam 11 of the breech 10. The cartridge hook 6 undertakes the extraction of the ammunition 4 from the ammunition feed 2, i.e. from the ammunition belt. Also in the case of only one ammunition feed, displacing and/or pivoting may be provided, but would not be necessary here. Providing it would however have the advantage that a safety-relevant and transporting position can also be assumed for this weapon system.

If only one ammunition feed 2 (3) is present, retrofitting for a second ammunition 5 can be quickly realized. For this purpose, the right-hand side guide 1.2 is docked, i.e. fastened, onto the guide 1, for example screwed on. Should the fastening part not provide any further receiving possibility for this, this fastening part may be exchanged for another fastening part 25 with two receptacles (holes) 26, 27. Alternative means of attachment by way of a plate, etc. are possible.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An ammunition feeding device comprising:

a belted ammunition in a weapon system for delivery before a breech or a breech head, the breech has a guide as a breech cam in an upper region of the breech; and a cartridge hook adapted to extract the ammunition from the ammunition belt and deliver to the breech, the cartridge hook having a pin functionally coupled with the breech, the cartridge hook being incorporated in the weapon system separately from the breech, the cartridge hook being carried along or placed in a deactivating manner by the breech when the breech travels a distance backward or forward.

2. The ammunition feed as claimed in claim 1, wherein the cartridge hook is integrated in the weapon system and movably coupled to a cradle.

3. An ammunition feeding device comprising:

a belted ammunition in a weapon system for delivery before a breech or a breech head, the breech has a guide as a breech cam in an upper region of the breech; and a cartridge hook adapted to extract the ammunition from the ammunition belt and deliver to the breech, the cartridge hook beinq incorporated in the weapon system separately from the breech, the cartridge hook being carried along or placed in a deactivating manner by the breech when the breech travels a distance backward or forward, wherein at least one side guiding part comprises a control cam and a guide cam for the cartridge hook, the guide cam having in a front portion a downwardly facing clearance and the control cam partially replicating the control of the cartridge hook.

4. The ammunition feed as claimed in claim 3, wherein the at least one side guiding part forms a feed.

5. The ammunition feed as claimed in claim 3, wherein two side guiding parts, which form a feed, are incorporated.

6. The ammunition feed as claimed in claim 1, wherein the breech cam having in a front region an upwardly facing clearance for the carrying along of the cartridge hook.

7. The ammunition feed as claimed in claim 1, wherein the pin realizes a functional interaction of the cartridge hook with the breech, the cartridge hook being separate from the breech.

8. The ammunition feed as claimed in claim 7, wherein the pin engages in the guide cam of the side guiding part for the cartridge hook and in the breech cam.

9. The ammunition feed as claimed in claim 1, wherein the breech has on an end face a groove into which the ammunition is deployed by the cartridge hook.

10. The ammunition feed as claimed in claim 9, wherein an ejector incorporated in the breech serves as a restriction for the ammunition during a delivery before the breech.

11. The ammunition feed as claimed in claim 3, wherein the at least one side guiding part is displaceable with the cartridge hook such that the pin of the cartridge hook is guided out of and into the breech cam.

12. The ammunition feed as claimed in claim 1, wherein the control cam of the cartridge hook is incorporated on an outside in the side guiding part and the guide cam for the cartridge hook is incorporated on an inside in the side guiding part.

13. The ammunition feed as claimed in claim 1, wherein on an end face of the cartridge hook there is a hook.

14. The ammunition feed as claimed in claim 13, wherein the hook on the cartridge hook is mounted in a pivot point.

15. The ammunition feed as claimed in claim 1, wherein the cartridge hook has in a front portion a fork or U shape that enclose the side guiding part, and wherein a bolt is incorporated on a right-hand inner side of the fork shape, and wherein the hook that is mounted at a pivot point is on an end face of the left-hand fork shape.

16. The ammunition feed as claimed in claim 1, wherein the cartridge hook is stabilized by way of a supporting part of the feed when the supporting part is guided together with the breech backward or forward.

17. The ammunition feed as claimed in claim 1, wherein a further bolt, with which the transport of the belted ammunition into the weapon system is made possible, is attached above the cartridge hook.

18. An ammunition feeding device comprising:

an ammunition in a weapon system;

a cartridge hook adapted to extract the ammunition and deliver the ammunition to a breech, the cartridge hook being incorporated in the weapon system separately from the breech; and at least one side guiding part comprising a control cam and a guide cam for the cartridge hook, the guide cam having in a front portion a downwardly facing clearance and the control cam replicating the control of the cartridge hook.

19. The ammunition feed as claimed in claim 18, wherein the cartridge hook is integrated in the weapon system and movably coupled to a cradle.

20. The ammunition feed as claimed in claim 18, wherein the at least one side guiding part forms a feed.

* * * * *